US008539780B2

(12) United States Patent
Herrera et al.

(10) Patent No.: US 8,539,780 B2
(45) Date of Patent: Sep. 24, 2013

(54) METHOD AND APPARATUS FOR HARVESTING ICE IN AN ICE MAKER SYSTEM

(75) Inventors: Carlos A. Herrera, Fisherville, KY (US); Russell James Fallon, Louisville, KY (US); Ronald Gary Foster, Louisville, KY (US); William Newton, Brooks, KY (US)

(73) Assignee: General Electric Company, Schenectady, NY (US)

( * ) Notice: Subject to any disclaimer, the term of this patent is extended or adjusted under 35 U.S.C. 154(b) by 695 days.

(21) Appl. No.: 12/824,987

(22) Filed: Jun. 28, 2010

(65) Prior Publication Data

US 2011/0314842 A1 Dec. 29, 2011

(51) Int. Cl.

| | |
|---|---|
| ***F25C 5/08*** | (2006.01) |
| ***F25C 1/24*** | (2006.01) |
| ***F25C 1/00*** | (2006.01) |
| ***F25C 1/04*** | (2006.01) |
| ***F25B 27/00*** | (2006.01) |

(52) U.S. Cl.
USPC ..... 62/73; 62/350; 62/351; 62/71; 62/356; 62/353; 62/238.5; 62/430

(58) Field of Classification Search
USPC ..... 62/351, 350, 73, 71, 356, 353, 238.5, 62/430
See application file for complete search history.

(56) References Cited

U.S. PATENT DOCUMENTS

| | | | | |
|---|---|---|---|---|
| 2,265,807 | A | 12/1941 | Hanft | |
| 3,059,445 | A * | 10/1962 | Kniffin | 62/135 |
| 3,736,767 | A * | 6/1973 | Lukes | 62/349 |
| 5,076,069 | A * | 12/1991 | Brown | 62/308 |
| 5,425,248 | A * | 6/1995 | Trantina | 62/349 |
| 6,370,904 | B2 | 4/2002 | Tchougounov et al. | |
| 6,631,616 | B2 * | 10/2003 | Wisniewski et al. | 62/66 |
| 7,444,829 | B2 * | 11/2008 | Mori et al. | 62/351 |
| 7,493,776 | B2 | 2/2009 | Lim et al. | |
| 7,762,092 | B2 * | 7/2010 | Tikhonov et al. | 62/186 |
| 2005/0115266 | A1 * | 6/2005 | Lim et al. | 62/351 |

FOREIGN PATENT DOCUMENTS

| | | |
|---|---|---|
| JP | 2008267630 | 11/2008 |
| WO | WO 2009078583 A1 * | 6/2009 |

* cited by examiner

*Primary Examiner* — Frantz Jules
*Assistant Examiner* — Erik Mendoza-Wilkenfel
(74) *Attorney, Agent, or Firm* — Global Patent Operations; Douglas D. Zhang

(57) ABSTRACT

Method and apparatus for ice maker systems are disclosed. One exemplary method comprises the steps of: heating an ice mold body to separate ice formed in the ice mold body from the ice mold body; releasing the separated ice from the ice mold body; and contacting at least a portion of the ice mold body with a heat transfer fluid to cool the ice mold body.

20 Claims, 5 Drawing Sheets

METHOD AND APPARATUS FOR HARVESTING ICE IN AN ICE MAKER SYSTEM

BACKGROUND OF THE INVENTION

The subject matter disclosed herein relates to ice maker systems, and more particularly to harvesting ice in an ice maker system.

Some ice maker systems, for example, in refrigerators, are known to employ heating elements to separate the ice from the ice mold used to form the ice. That is, a certain amount of heat is applied for a limited time to the ice mold so that the bond formed between the ice and the ice mold during ice formation is broken, allowing the ice to be more easily released from the ice mold.

Separation and release of the ice from the ice mold may be referred to as "harvesting" the ice. However, the heat used to separate the ice from the ice mold slows down the production of more ice because the ice mold has to cool down to a sufficient temperature after every harvest so that ice formation can begin again in the next cycle.

BRIEF DESCRIPTION OF THE INVENTION

As described herein, the exemplary embodiments of the present invention overcome one or more disadvantages known in the art.

One aspect of the present invention relates to a method comprising the steps of: heating an ice mold body to separate ice formed in the ice mold body from the ice mold body; releasing the separated ice from the ice mold body; and contacting at least a portion of the ice mold body with a heat transfer fluid to cool the ice mold body. The heat transfer fluid is different from or other than the cooling medium used to freeze water in the ice mold to make ice.

Another aspect of the present invention relates to an apparatus comprising: an ice mold body for forming ice therein; a heating element proximate to the ice mold body for heating the ice mold body to separate the ice formed in the ice mold body from the ice mold body such that the separated ice is releasable from the ice mold body; and a heat transfer fluid reservoir for permitting a heat transfer fluid contained in the reservoir to contact at least a portion of the ice mold body to cool the ice mold body.

Yet another aspect of the present invention relates to an apparatus comprising: an ice mold assembly comprising an ice mold body for forming ice therein, and a heat transfer fluid reservoir for containing a heat transfer fluid; a heating element assembly proximate to the ice mold assembly; and an ice mold rotator assembly for rotating the ice mold assembly; wherein, during an ice harvesting cycle, the heating element heats the ice mold body to separate the ice formed in the ice mold body from the ice mold body, and the ice mold rotator assembly rotates the ice mold assembly such that the separated ice is released from the ice mold body and the heat transfer fluid progressively contacts the ice mold body as the ice mold assembly rotates.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of an ice maker system in a refrigerator appliance, such as a household refrigerator. However, it is to be understood that methods and apparatus of the invention are not intended to be limited to ice maker systems in household refrigerators. Rather, methods and apparatus of the invention may be applied to and deployed in any other suitable environments in which it would be desirable to cool an ice mold that has been heated during the ice harvesting process in order to more quickly render the ice mold ready for ice formation again, and thus shorten the overall time associated with the ice formation and ice harvesting cycles of the ice maker system. Accordingly, an ice maker system incorporating one or more embodiments of the invention may be referred to as a "rapid recovery" ice maker system.

Figure 1:
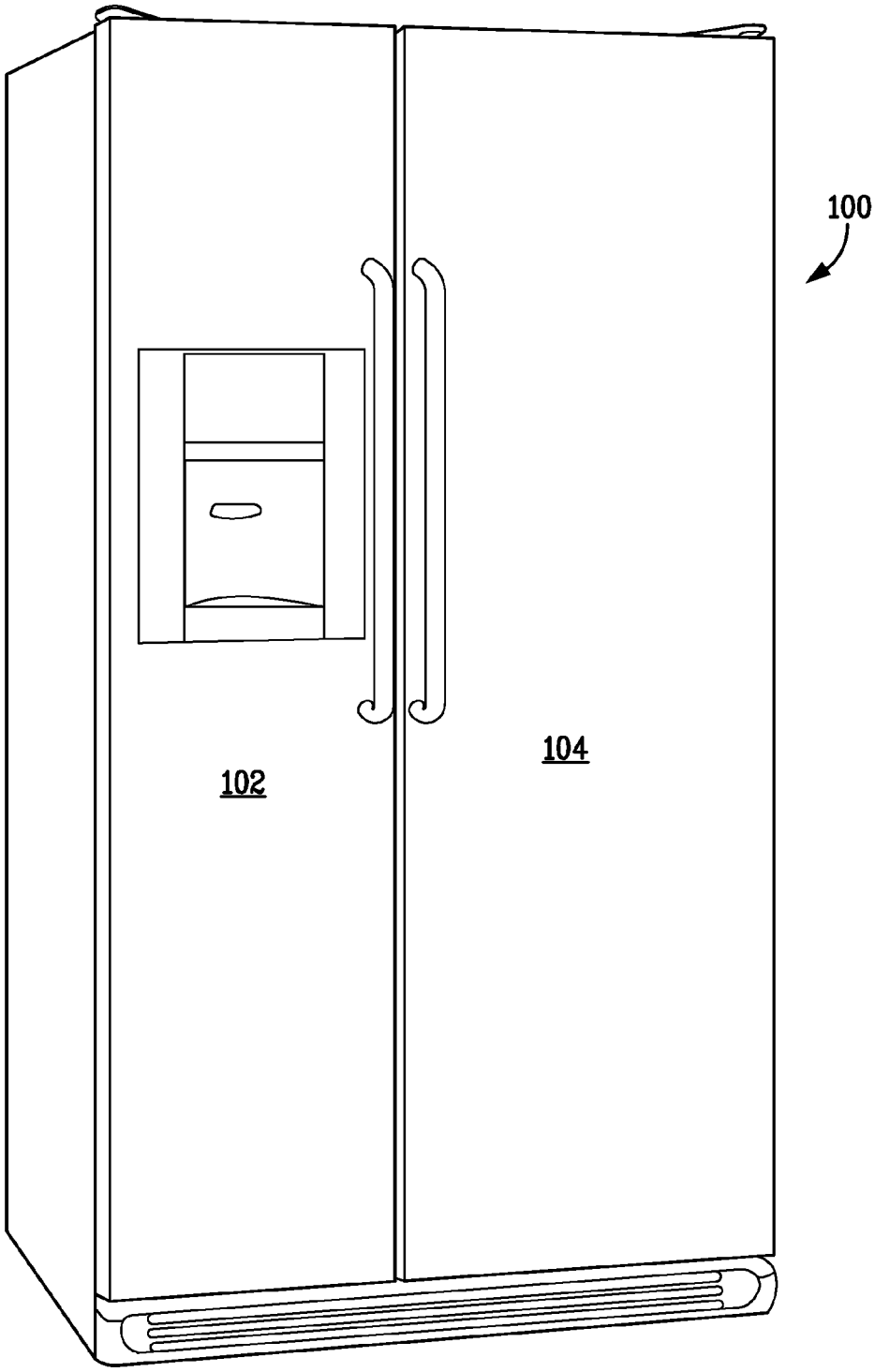
FIG. 1 is a diagram of a refrigerator, in accordance with an embodiment of the invention.

FIG. 1 illustrates an exemplary refrigerator 100 within which an ice maker system according to an embodiment of the invention may be deployed. As is typical, a refrigerator has a freezer portion 102 and a refrigerator portion 104. The refrigerator portion typically maintains foods and products stored therein at temperatures at or below about 40 degrees Fahrenheit in order to preserve the items therein, and the freezer portion typically maintains foods and products at temperatures below about 32 degrees Fahrenheit in order to freeze the items therein.

While the exemplary refrigerator 100 in FIG. 1 illustrates the freezer portion 102 and the refrigerator portion 104 in a side-by-side configuration, it is to be understood that other configurations are known, such as top freezer configurations where the freezer portion 102 is situated on top of the refrigerator portion 104, and bottom freezer configurations where the freezer portion 102 is situated below the refrigerator portion 104. Also, viewing the refrigerator 100 from the front, the freezer portion 102 may be located to the right of the refrigerator portion 104, as opposed to being located to the left as shown in FIG. 2.

It is to be appreciated that an ice maker system according to an embodiment of the invention may be deployed in the freezer portion 102 of the refrigerator 100. However again, methods and apparatus of the invention are not intended to be limited to deployment in a refrigerator such as the one depicted in FIG. 1.

Figure 2:
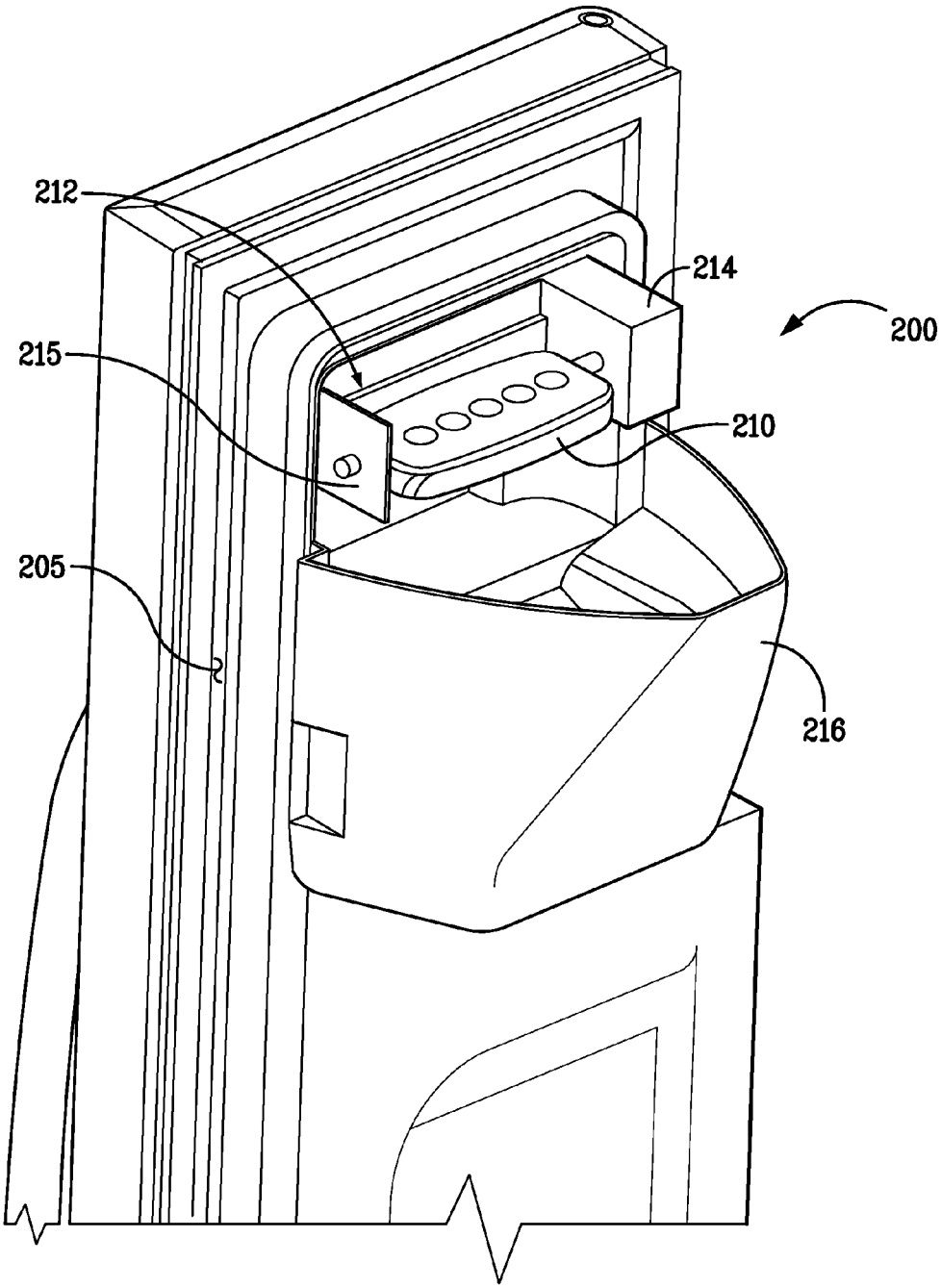
FIG. 2 is a diagram of a ice maker system, in accordance with an embodiment of the invention.

Referring now to FIG. 2, an ice maker system 200, in accordance with an embodiment of the invention, is shown. Ice maker system 200 may be referred to as a rapid recovery ice maker system. In this exemplary embodiment, the ice maker system is shown as being mounted on the inside door 205 of the freezer portion of a household refrigerator (e.g., the freezer portion 102 of the refrigerator 100 in FIG. 1). However, methods and apparatus of the invention are not intended to be limited to such a configuration. By way of example only, the ice maker system 200 may alternatively be mounted on an inside wall (not shown) of the freezer portion of the refrigerator. Also, the ice maker system 200 could alternatively be deployed in a storage compartment of the refrigerator other than the freezer.

As shown in FIG. 2, the ice maker system 200 comprises an ice mold assembly 210, a heating element assembly 212, an ice mold rotator assembly 214, a bracket assembly 215, and an ice bucket assembly 216.

It is to be understood that the ice maker system 200 includes other components such as, but not limited to, a water inlet assembly (for use in supplying water to the compartments of the ice mold for freezing), and control circuitry (for use in monitoring, sensing, processing and otherwise controlling the timing of the various stages of the ice formation and harvesting cycles). However, for the sake of clarity of illustration, these and other typical components are not shown or explained further unless useful for a better understanding of the illustrative embodiments of the invention. One of ordinary skill in the art will know and understand their typical functions and operations in the context of the illustrative detailed descriptions herein.

The heating element 212 may be any suitable type of heating element. By way of one example, the heating element 212 may be a resistive heating element. In such an embodiment, an electric current is applied to one or more resistor elements and the resistor elements, which are in proximity to the ice mold and generate heat, heat up the ice mold to a suitable temperature so as to separate the ice from the inside wall of the ice mold compartment in which the ice resides. It is to be appreciated that the resistive heating element assembly is typically in contact, or in sufficiently close proximity with the ferrous ice mold for efficient heat transfer from the resistive heating element to the ice mold.

In another embodiment, the heating element 212 may be an inductive heating element. In such an embodiment, an alternating current is applied to a coil, thus creating a magnetic field. The ice mold, which may preferably be made of a ferrous material (and thus current conducting) and placed in an operationally-effective proximity to the coil (i.e., within the magnetic field), experiences induced eddy currents therein. These eddy currents generate non-contact heat in the ice mold itself, without generating appreciable heat in the coil that generates the magnetic field. It is realized that inductive heating provides efficient and localized use of energy to uniformly heat the ice mold body. It is to be appreciated that the ice mold can also be formed from another current-conducting material such as aluminum or steel. One skilled in the art will realize other materials that can be used to form the ice mold.

While two examples of heating elements have been described above, it is to be understood that methods and apparatus of the invention are not limited to any particular type of heating element. Thus, the depiction of the heating element assembly 212 in FIG. 2 is not intended to represent any specific type of heating element but rather is intended to generally represent any suitable type of heating element.

Before describing illustrative details of the ice mold assembly below in the context of FIGS. 3 through 8, a general description of the ice formation and harvesting cycles will now be described. Note that some typical components of an ice maker system that are not shown in the figures for sake of clarity will be mentioned below in the general description. One skilled in the art will recognize and know their typical functions and operations.

First, during the ice formation cycle, control circuitry of the ice maker system signals a water-fill valve of the water inlet assembly to open and cause water to flow into the ice formation compartments of the ice mold (in one example, semi-spherical shaped molds in the ice mold—although any other suitably shaped compartment may be employed). The control circuitry also signals to shut off the valve when a specified amount of water has been provided to the compartments. Typically such fills are controlled by shutting off the valve when a predetermined time has elapsed. Alternatively such fills may be controlled with some form of water level sensing arrangement.

Due to the freezing or below freezing temperature in the freezer portion of the refrigerator in which the ice maker system resides, the water freezes in the compartments of the ice mold thus forming ice. When a thermostat senses that the ice mold has reached a certain temperature (i.e., the ice is ready to harvest), the thermostat signals the control circuitry of the ice maker system to begin release of the ice, thus ending the ice formation cycle and beginning the ice harvesting cycle. It is to be appreciated that a thermistor can be used rather than a thermostat. In any event, the control circuitry turns on the heating element, which warms the ice mold sufficiently to separate the ice from the inside walls of the ice mold compartments such that the ice formed in each compartment can move freely.

Once the ice is free to be released from the ice mold, a release mechanism is activated to move the ice from the ice mold to the ice bucket or storage assembly. In some ice maker systems, the release mechanism includes a rake, a sweep arm, or a push bar for moving the ice from the ice mold and dropping it into the ice bucket.

In the embodiment of the invention illustrated in FIG. 2, the release mechanism includes an ice mold rotator assembly 214 that, under control of the control circuitry of the ice maker system, rotates the ice mold assembly from an upright position to a specified rotational position that allows gravity to cause the ice to move out of the compartments and fall into the ice bucket assembly 216. This operation will be described in more detail below in the context of FIGS. 3 and 5. While not specifically shown in FIG. 2, the ice mold rotator assembly 214 comprises a motor with a shaft that is attached to a rotational pivot shaft on the ice mold assembly 210 such that as the motor shaft turns, so does the ice mold assembly.

After the harvesting cycle is completed, the control circuitry of the ice maker system returns the release mechanism back to its original position (non-harvesting position) and begins the ice formation cycle over again.

However, as mentioned above, the heat used to separate the ice from the ice mold slows down the production of more ice because the ice mold has to cool down to a sufficient temperature after every harvest so that ice formation can begin again in the next cycle.

Figure 3:
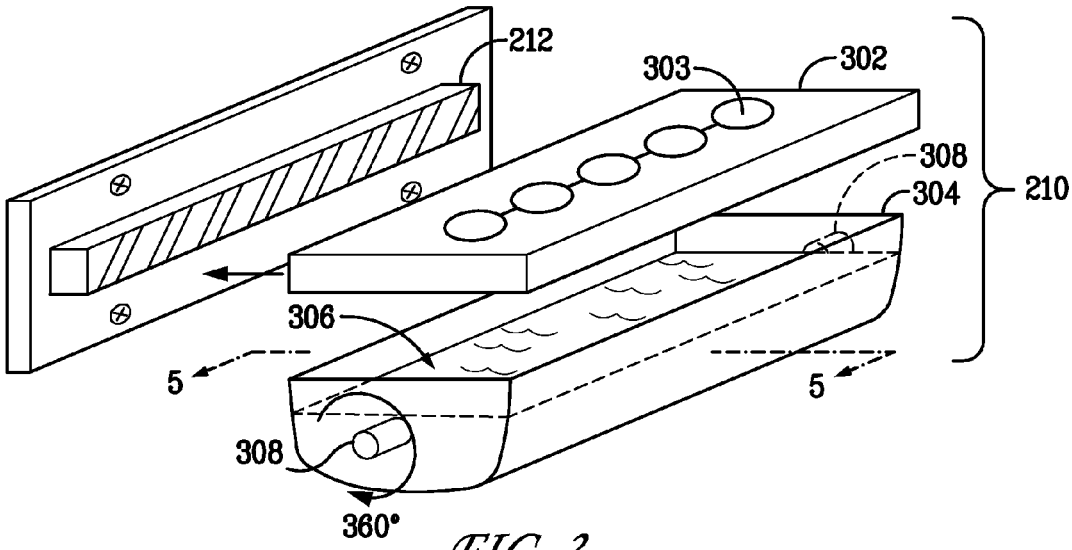
FIG. 3 is a diagram of an exploded view of components of an ice maker system, in accordance with an embodiment of the invention.

This and other problems are addressed by an ice mold assembly configured in accordance with the invention, an exemplary embodiment of which is generally shown in FIG. 2 and more specifically shown in the exploded view of FIG. 3.

Referring now to FIG. 3, the ice mold assembly 210 is shown in an exploded view and in relation to its position with respect to the heating element assembly 212. As shown, the ice mold assembly 210 comprises an ice mold body 302 with a plurality of ice formation compartments 303 formed therein, and a heat transfer fluid reservoir 304 with heat transfer fluid 306 contained therein. The ice mold assembly 210 also comprises a pair of rotational pivot shafts 308.

The ice mold body 302 can be fixed or interchangeable to allow for different shapes of ice. In this embodiment, the compartments 303 are shown as semi-spherical shapes, but it is to be understood that any suitable shape for the ice formation compartment can be used. The ice mold body 210 is preferably made of a ferrous material. However, other examples of material from which the ice mold body may be formed include, but are not limited to, steel or aluminum. Examples of dimensions for an ice mold body are approximately 7 inches in length, approximately 3 inches in width, and approximately 1.5 inches in depth. However, methods and apparatus of the invention are not limited to any specific materials or dimensions. In another embodiment, the ice body mold may have surface augmentations such as cooling fins as will be illustratively described below in the context of FIGS. 6-8.

The ice mold body 302 is attached to the heat transfer reservoir 304. In an embodiment where the ice mold body is fixed, and not intended to be changed by a consumer or operator of the ice maker system, the ice mold body 302 is sealed to the heat transfer fluid reservoir 304 such that no heat transfer fluid can leak out of the ice mold assembly 210 during rotation. For example, this seal (not shown) may include some form of epoxy, glue, or other sealing substance that will not substantially degrade in the operating environment. In an embodiment where the ice mold body is intended to be interchangeable by the consumer or operator, a detachable sealing mechanism is employed that permits selective detachment of the ice mold body 302 from the reservoir 304. For example, the ice mold assembly 210 may include a rubber (or more generally, leak proof) gasket and a clamping mechanism (not shown). In such a case, the gasket is fitted to provide a leak-proof seal between the ice mold body and the reservoir and held in place by the clamping mechanism. One of ordinary skill in the art will appreciate other sealing and retention mechanisms that may be used.

As shown, the heat transfer fluid reservoir 304 contains the heat transfer fluid 306. Examples of material which the heat transfer fluid reservoir may be composed of include, but are not limited to, molded plastic, steel or aluminum. As is evident, examples of dimensions would be dependent on the dimensions of the ice mold body. One skilled in the art will realize appropriate materials and dimensions given the inventive teachings provided herein.

A main purpose of the heat transfer fluid is to assist in cooling the ice mold body 302 after it is heated by heating element 212 and the ice is separated and released (or in the process of being released) from the ice mold body. The ice mold body will begin to cool after the heating element is turned off due to the chilled ambient air that is present in the freezer portion in which the ice maker system resides. However, the heat transfer fluid, as will be explained below, is used to contact the ice body mold in order to cool the ice body mold more rapidly than would otherwise be possible via ambient air cooling alone.

As is known, a heat transfer fluid is a fluid which transfers the heat produced by an assembly body or device with which the fluid comes into contact away from that assembly body or device. In the case of the heat transfer fluid 306, the fluid comes into contact with the heated ice mold body 302 (as will be illustratively explained below in the context of FIG. 5) and transfers heat away from the ice mold body so as to speed up the cooling of the ice mold body (in conjunction with the chilled ambient air in the operating environment). Preferred examples of a heat transfer fluid that may be employed in illustrative embodiments are fluids that have one or more of the following characteristics: high thermal capacity, low viscosity, low-cost, non-toxic, single phase, chemically inert, neither causing nor promoting corrosion of the assembly which holds the fluid. Examples of heat transfer fluids that may be employed include, but are not limited to, glycol-based solutions, e.g., a solution of a suitable organic chemical (e.g., ethylene glycol, diethylene glycol, or propylene glycol) in water. Such a solution may be referred to as "antifreeze" since it must maintain its desirable heat transfer characteristics in freezing and sub-freezing temperatures. In one embodiment, the heat transfer fluid may be propylene glycol (approximately 55% concentration). Other examples of types of heat transfer fluid include, but are not limited to, brine or alcohol. One skilled in the art will realize other fluids and liquids that may be used as a heat transfer medium given the inventive teachings provided herein.

In general, and as will be more specifically illustrated in FIG. 5, the heat transfer fluid 306 works as follows with respect to the ice mold body 302 and the heat transfer fluid reservoir 304. Once the ice mold assembly 210 rotates to release the ice, gravity causes the heat transfer fluid 306 that is resting at the bottom of the reservoir 304 to come in contact with the under side of the ice mold body 302. The fluid 306 quickly dissipates the heat generated during harvesting due to heating (via heating element 212) of the ice mold body 302. Once harvest and deployment of the ice is completed, the assembly moves back to an ice formation position, the heat transfer fluid 306 moves back to the bottom of the reservoir 304 and the mold body 302 is ready again to fill.

It is to be understood that, at this point, the heat transfer fluid will begin to cool due to the chilled ambient air that is present in the freezer portion in which the ice maker system resides. Note that the heat transfer fluid, after absorbing the heat from the ice mold, can be afforded a longer time to cool than the ice mold. As mentioned above, it is desirable for the ice mold to cool quickly (i.e., rapidly recover) so that it can quickly begin the next ice formation cycle. However, the heat transfer fluid can rely on the chilled ambient air that is present in the freezer portion and cool during the time it takes for the next ice formation cycle to complete. At that time, the heat transfer fluid is sufficiently cooled and the next ice harvesting cycle can begin. It is to be appreciated that the cooling system of the freezer (or, more generally, the refrigerator appliance) removes the heat that the heat transfer fluid absorbed from the ice mold. In an alternative embodiment, other techniques and mechanisms could be employed to dissipate (or assist in dissipation of) the heat absorbed by the heat transfer fluid.

Figure 4:
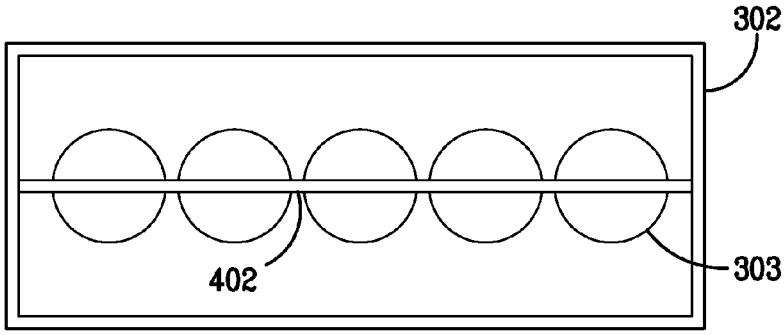
FIG. 4 is a diagram of a bottom view of an ice mold body, in accordance with an embodiment of the invention.

As shown in FIG. 4 (which is a bottom view of the ice mold body 302), the ice body mold 302 may have a heat sink 402 in one alternative embodiment. A main purpose of the heat sink 402 is to assist in the transfer of heat from the ice mold body 302 to the fluid 306. Thus, in such an embodiment, some or all of the heat generated in the ice mold body 302 during heating is transferred to and thus is focused in the heat sink 402. The heat sink 402, as well as the under side of the ice mold body 302, come into contact with the heat transfer fluid 306, thus optimizing heat transfer away from the ice mold body 302.

Figure 5:
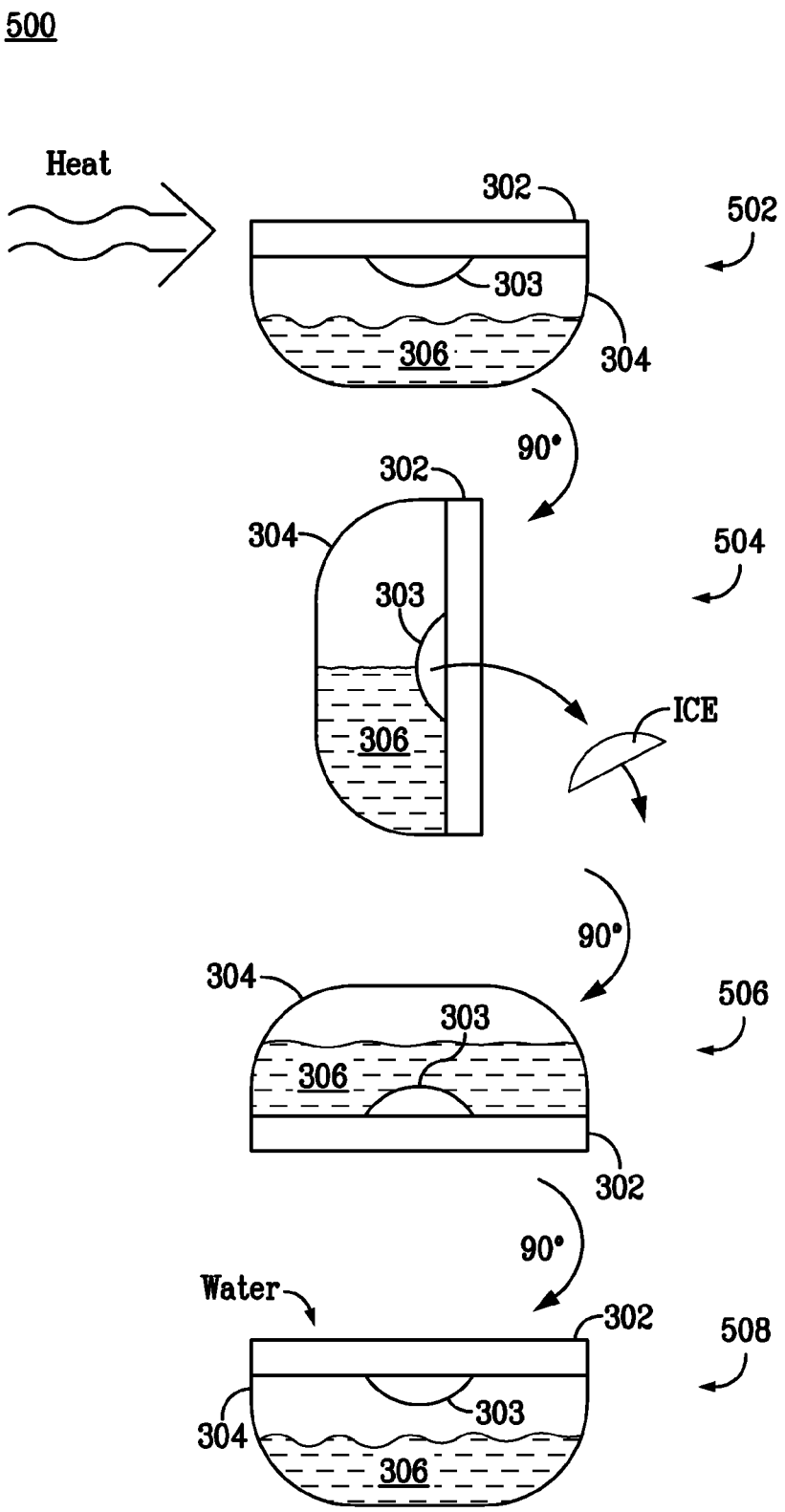
FIG. 5 is a diagram of an ice harvesting methodology, in accordance with an embodiment of the invention.

Referring now to FIG. 5, an ice harvesting methodology 500 according to an embodiment of the invention is shown. Note that the view shown in FIG. 5 is a cross sectional view taken at line 5-5 of FIG. 3.

As shown in step 502, note that the heat transfer fluid 306 is filled to a level in the reservoir 304 such that during the ice formation cycle (when water is freezing into ice in the ice mold body 302), the fluid 306 does not come in contact with the ice mold body 302 including its compartments 303 (or the heat sink 402 in such an embodiment as shown in FIG. 4—which is not shown in FIG. 5 for the sake of clarity). Once ice is formed, heat from heating element 212 is introduced to separate the ice from the compartments as explained above.

In step 504, the reservoir 304 is rotated. Recall from FIG. 2 that the ice mold assembly 210 is attached to the ice mold rotator assembly 214 that, under control of the control circuitry of the ice maker system, rotates the ice mold assembly 210 from an upright position (step 502 position) to a specified rotational position (step 504 position) that allows gravity to cause the ice to move out of the compartments and fall into the ice bucket assembly 216 below. As mentioned, the ice mold rotator assembly 214 comprises a motor with a shaft that is attached to a rotational pivot shaft on the ice mold assembly 210 such that as the motor shaft turns, so does the ice mold assembly. The rotational pivot shaft that attaches to the motor is shown in FIG. 3 as shaft 308 formed on reservoir 304. Note that there is a substantially identical shaft 308 on the side of the reservoir 304 opposite the motor which is positioned to be retained in bracket assembly 215 so as to allow the ice mold assembly 210 to appropriately rotate.

Note that the direction of rotation is initially away from the heating element 212 but, depending on the spatial clearance between the ice mold assembly 210 and the heating element 212, the rotational direction could be reversed. Also note that, in step 504, the heat transfer fluid 306 comes into contact with a part of the bottom surface (under side) of the ice mold body 302 including parts of each ice formation compartment 303 to begin the above-mentioned heat transfer process and thus begin to cool the ice mold body 302.

Now in step 506, after the ice has been released from the ice mold body 302, the ice mold assembly 210 is again rotated. This rotational position in step 506 is about 180 degrees opposite the upright position in step 502. In this manner, as shown, the heat transfer fluid 306 contacts, substantially, the entire bottom of the ice mold body 302 including the entire bottom surfaces of each ice formation compartment 303. Thus, the heat transfer process continues and the ice mold body 302 continues to cool. Advantageously, note that as the ice mold assembly 210 is rotated, the heat transfer fluid 306 progressively contacts the ice mold body 302.

In step 508, the ice mold assembly 210 is returned to its original upright (ice formation cycle) position, thus ending the ice harvesting cycle. Note that, as shown in step 508, the heat transfer fluid 306 is again no longer in contact with the ice mold body 302. Now with the ice mold body 302 cooled to a sufficient temperature, the ice formation cycle can begin again, i.e., water added to each compartment 303 as explained above.

It is to be understood that while the above description of FIG. 5 mentions discrete rotational positions, the ice harvesting methodology 500 can include more positions than specifically mentioned. Also, the description of discrete rotational position of the ice mold assembly 210 is not intended to mean that the ice mold assembly 210 is required to make discrete stops at each position (although, it could) but rather, in the alternative, the rotation may be a continuous motion. In either case, it is to be appreciated that the rotational speed and timing associated with the discrete stops or continuous motion is dictated by the amount of heat that needs to be dissipated in order to cool the ice mold body 302 to a temperature that will render it ready to form ice again.

It is also to be appreciated that while the figures and description above describe the rotation of the ice mold assembly 210 being along a rotational axis going through the center of the ice mold assembly, the configuration of the ice mold assembly and the rotator assembly may be different to enable an alternative rotational axis. For example, in one alternative, the ice mold assembly 210 may detach from bracket assembly 215 and, at the connection between the ice mold assembly 210 and the rotator assembly 214, rotationally pivot (e.g., on a hinge) downward toward the ice bucket assembly 216. In this manner, the separated ice would release due to gravity and the heat transfer fluid would contact the ice mold body to effectuate cooling as described above. The ice mold assembly 210 would then return to the upright position to begin ice formation again.

Figure 6:
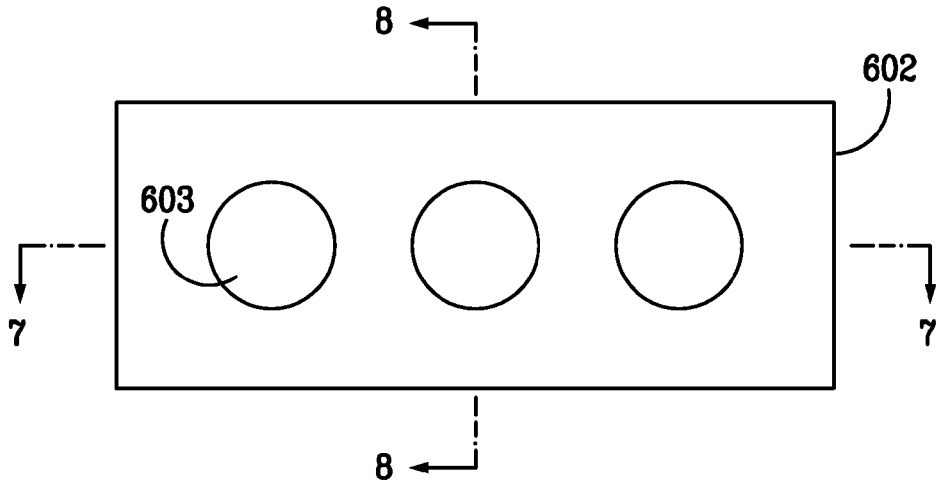
FIG. 6 is a diagram of an ice mold body, in accordance with another embodiment of the invention.
Figure 7:
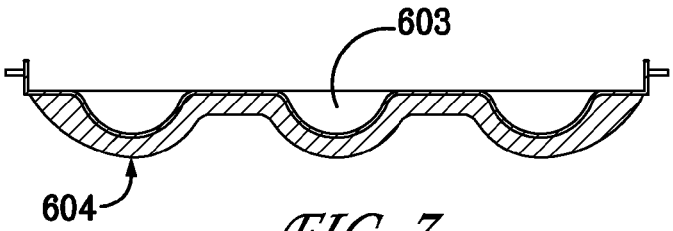
FIGS. 7 and 8 are cross section views along lines 7-7 and 8-8 in FIG. 6.
Figure 8:
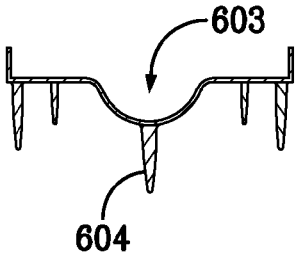

Lastly, FIGS. 6-8 show an ice mold body, in accordance with another embodiment of the invention. Ice mold body 602 is formed similar to ice mold body 302, i.e., preferably made of the same or similar ferrous material (or an alternative non-ferrous material mentioned above) and having ice formation compartments 603 (similar to ice formation compartments 303), but with the notable exception that ice mold body 602 includes surface augmentations in the form of a plurality of cooling fins 604. In one embodiment, the cooling fins 604 are formed as a unitary part of the ice mold body using the same or similar ferrous material. As is known, cooling fins and other such surface augmentations are used to improve the cooling of a device or assembly body whereby the additional surface area offered by the surface augmentation increases the convection heat transfer effectuated by the chilled ambient air in the operating environment (in this case, the freezer portion of the refrigerator).

While the cooling fins 604 are shown in FIGS. 6-8 as relatively thin fins running the length of the ice mold body 602, it is to be understood that other forms of heat transfer surface augmentations may be employed. One of ordinary skill in the art will know and understand how to select the size, shape and material of such surface augmentations given the heat/cooling (temperature) profiles that are present in the operating environment.

Regarding the use of the ice mold body 602 in the ice mold assembly 210, it is to be understood that the shape and dimensions of the cooling fins 604 are selected such that they remain out of contact with the heat transfer fluid 306 while the ice mold assembly 210 is in the upright (ice formation cycle) position. That is, the fins are not to come in contact with the fluid 306 until the ice is being released or is released from the ice mold body 302 (see, e.g., step 504 of FIG. 5).

It is to be appreciated that one skilled in the art will realize that well-known heat exchange and heat transfer principles may be applied to determine appropriate dimensions and materials of the various assemblies illustratively described herein, as well as quantities of heat transfer fluid that may be appropriate for various applications and operating conditions, given the inventive teachings provided herein. While methods and apparatus of the invention are not limited thereto, the skilled artisan will realize that such quantities, dimensions and materials may be determined and selected in accordance with well-known heat exchange and heat transfer principles as described in R. K. Shah, "Fundamentals of Heat Exchanger Design," Wiley & Sons, 2003 and F. P. Incropera et al., "Introduction to Heat Transfer," Wiley & Sons, 2006, the disclosures of which are incorporated by reference herein.

It is to be further appreciated that the ice maker systems described herein may have control circuitry including, but not limited to, a microprocessor (processor) that is programmed, for example, with suitable software or firmware, to implement one or more techniques as described herein. In other embodiments, an ASIC (Application Specific Integrated Circuit) or other arrangement could be employed. One of ordinary skill in the art will be familiar with ice maker systems and given the teachings herein will be enabled to make and use one or more embodiments of the invention; for example, by programming a microprocessor with suitable software or firmware to cause the ice maker system to perform illustrative steps described herein. Software includes but is not limited to firmware, resident software, microcode, etc. As is known in the art, part or all of one or more aspects of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the worldwide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Furthermore, it is also to be appreciated that methods and apparatus of the invention may be implemented in electronic ice maker systems under control of one or more microprocessors and computer readable program code, as described above, or in electromechanical ice maker systems where operations and functions are under substantial control of mechanical control systems rather than electronic control systems.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method comprising:

heating an ice mold body to separate ice formed in the ice mold body from the ice mold body;

releasing the separated ice from the ice mold body; and contacting at least a portion of the ice mold body with a given amount of a heat transfer fluid inescapably confined within a heat transfer reservoir sealed to the ice mold body to cool the ice mold body, the heat transfer fluid being other than a cooling medium used to freeze water in the ice mold to make ice.

2. The method of claim 1, wherein the step of heating the ice mold body to separate ice formed in the ice mold body from the ice mold body further comprises inductive heating.

3. The method of claim 1, wherein the step of heating the ice mold body to separate ice formed in the ice mold body from the ice mold body further comprises resistive heating.

4. The method of claim 1, wherein the step of releasing the separated ice from the ice mold body further comprises rotating the ice mold body such that the separated ice is released from the ice mold body.

5. The method of claim 4, wherein the step of contacting at least a portion of the ice mold body with the heat transfer fluid to cool the ice mold body further comprises progressively contacting the ice mold body with the heat transfer fluid as the ice mold body rotates.

6. A method comprising:

heating an ice mold body to separate ice formed in the ice mold body from the ice mold body;

releasing the separated ice from the ice mold body; and contacting at least a portion of the ice mold body with a heat transfer fluid to cool the ice mold body, the heat transfer fluid being other than a cooling medium used to freeze water in the ice mold to make ice;

wherein the step of releasing the separated ice from the ice mold body further comprises rotating the ice mold body such that the separated ice is released from the ice mold body;

wherein the step of contacting at least a portion of the ice mold body with the heat transfer fluid to cool the ice mold body further comprises progressively contacting the ice mold body with the heat transfer fluid as the ice mold body rotates; and further comprising the step of returning the ice mold body to an ice formation position such that the heat transfer fluid no longer contacts the ice mold body.

7. An apparatus comprising:

an ice mold body for forming ice therein;

a heating element proximate to the ice mold body for heating the ice mold body to separate the ice formed in the ice mold body from the ice mold body such that the separated ice is releasable from the ice mold body; and a heat transfer fluid reservoir sealed to the ice mold body for permitting a given amount of a heat transfer fluid inescapably confined within the reservoir to contact at least a portion of the ice mold body to cool the ice mold body.

8. The apparatus of claim 7, wherein the ice mold body further comprises one or more surface augmentations for assisting in cooling of the ice mold body.

9. The apparatus of claim 8, wherein the one or more surface augmentations further comprise a plurality of cooling fins.

10. The apparatus of claim 9, wherein the cooling fins are located on a bottom surface of the ice mold body.

11. The apparatus of claim 7, wherein the ice mold body further comprises a heat sink.

12. The apparatus of claim 7, wherein the heating element further comprises an inductive heating element.

13. The apparatus of claim 7, wherein the heating element further comprises a resistive heating element.

14. The apparatus of claim 7, wherein the heat transfer fluid further comprises a glycol-based solution.

15. The apparatus of claim 7, further comprising an ice mold rotator assembly for rotating the ice mold body such that the separated ice is released from the ice mold body.

16. The apparatus of claim 15, wherein the ice mold rotator assembly rotates the ice mold body such that the heat transfer fluid progressively contacts the ice mold body as the ice mold body rotates.

17. The apparatus of claim 7, wherein the ice mold body is fixed to the heat transfer fluid reservoir.

18. The apparatus of claim 7, wherein the ice mold body is selectively detachable from the heat transfer fluid reservoir.

19. An apparatus comprising:

an ice mold assembly comprising an ice mold body for forming ice therein, and a heat transfer fluid reservoir sealed to the ice mold body inescapably confining therein a given amount of a heat transfer fluid;

a heating element assembly proximate to the ice mold assembly; and an ice mold rotator assembly for rotating the ice mold assembly;

wherein, during an ice harvesting cycle, the heating element heats the ice mold body to separate the ice formed in the ice mold body from the ice mold body, and the ice mold rotator assembly rotates the ice mold assembly such that the separated ice is released from the ice mold body and the heat transfer fluid progressively contacts the ice mold body as the ice mold assembly rotates.

20. The apparatus of claim 19, further comprising an ice bucket assembly for storing the released ice.

* * * * *